United States Patent [19]

Gliwa et al.

[11] Patent Number: 4,516,737

[45] Date of Patent: May 14, 1985

[54] STORAGE REEL WITH PERIPHERAL CORE RELIEF

[75] Inventors: William F. Gliwa, Alsip; Robert F. Kalina, Lombard, both of Ill.

[73] Assignee: AT&T Technologies, Inc., New York, N.Y.

[21] Appl. No.: 499,072

[22] Filed: May 27, 1983

[51] Int. Cl.[3] ..... B65H 75/28; B21B 41/08

[52] U.S. Cl. ..... 242/77; 242/77.1; 242/74

[58] Field of Search ..... 242/77, 77.1, 83, 118.4, 242/74, 71.8, 68.5

[56] References Cited

U.S. PATENT DOCUMENTS

| | | | |
|---|---|---|---|
| 327,038 | 9/1885 | Thomas | 242/74 |
| 1,475,622 | 11/1923 | Davis | 242/74 |
| 1,890,823 | 12/1932 | Nuhring | 242/74 |
| 1,956,191 | 4/1934 | Crooks | 242/118.4 |
| 2,676,765 | 4/1954 | Kaplan | 242/68.5 |
| 3,313,497 | 4/1967 | Keech | 242/68.5 |
| 4,008,863 | 2/1977 | Fohl | 242/107.4 B |
| 4,015,793 | 4/1977 | Hemminger | 242/74 |
| 4,305,554 | 12/1981 | Anderson | 242/107.4 A |

FOREIGN PATENT DOCUMENTS

| | | | |
|---|---|---|---|
| 275980 | 11/1973 | U.S.S.R. | 242/77.1 |

*Primary Examiner*—Stuart S. Levy
*Assistant Examiner*—Lloyd D. Doigan
*Attorney, Agent, or Firm*—K. R. Bergum; M. de Picciotto; H. St. Julian

[57] ABSTRACT

A storage reel (10, 10') particularly adapted for winding bandoliered, axially leaded, tubular components thereon, such as capacitors (18), includes a core (12, 12') formed with a uniquely configured peripheral relief (32, 44, 46). The relief, in accordance with one preferred embodiment (32), has a concave base, and is dimensioned to accommodate the lower half body portions of a predetermined number of bandoliered, forward end capacitors (18), when wound as part of the first wrap of such components on the core, via a pair of laterally spaced lead-supporting tape carriers (26, 27). The relief is centrally located on the core so as to define on each side thereof a circumferentially displaced, lead-supporting peripheral core border region (12*a* or *b*). The relief, as dimensioned and located, cooperates with the core border regions to eliminate any possible tape carrier-induced bending of those bandoliered components in the first wrap that are partially nested therewithin, and to substantially minimize the otherwise maximum possible bending that can occur in the leads of those components in the second wrap that overlie the relief. Thereafter, the then considerably larger, and progressively increasing, effective diameter of the core, and the use of a paper separator (29) interposed between adjacent wraps, both contribute in preventing any detrimental permanent bends being formed in the leads as the capacitors continue to be wound in bandolier fashion on the reel core.

4 Claims, 7 Drawing Figures

STORAGE REEL WITH PERIPHERAL CORE RELIEF

FIELD OF THE INVENTION

This invention relates to a storage reel of the type adapted for winding bandoliered, leaded components thereon and, more particularly, to the construction of the core thereof for that purpose.

BACKGROUND OF THE INVENTION

In a bandoliering operation, leaded components, such as tubular capacitors, are typically wound via a pair of laterally spaced tape carriers, for example, upon a take-up reel for temporary storage and/or transport. A paper separator is generally interposed between successive capacitor wraps. As thus wound, the outer tape carrier-secured ends of all of the axially disposed capacitor leads of the first wrap are normally bent toward and against a conventional core by an amount equal to ½ the diameter of the body portion of a given capacitor, when of cylindrical configuration.

At the start of the second wrap of such axially leaded capacitors, the leads are normally bent toward, and often against, a conventional reel core by an amount, which in the latter case, would equal 1½ times the diameter of the body portion of each capacitor. When the leads are relatively fragile, such as when of 22 gauge copper clad steel, for example, the tape carrier-induced force exerted against the leads of the first few capacitors at the start of the first and second wraps, in particular, can readily result in permanent bends being formed therein.

Such detrimental lead bends are directly attributable to the effective core diameter being smallest at the start of the first wrap, and to the combination of a relatively small effective core diameter and a relatively large possible lead bend displacement at the start of the second wrap. Up to that point during a winding operation, the relatively flexible paper separator normally has no appreciable effect in limiting the tape carrier-imparted displacement of the capacitor leads.

Unfortunately, whenever permanent bends are formed in any of the capacitor leads during the bandoliered winding (or unwinding) thereof, a time-consuming lead-straightening operation must normally be performed on such leads prior to the affected capacitors (or any other similarly leaded components) being inserted into aligned thru-holes of a circuit board, for example. A lead-straightening operation on those capacitors having acquired permanent bends normally is imperative when the insertion operation is to be performed by an automatic component insertion machine.

After the first few leaded capacitors of the second wrap have been wound about a reel core, the remaining capacitors in the second and subsequent wraps normally do not present a serious problem with respect to being subjected to detrimental lead bending. This results because of both the considerably larger effective core diameter at that time, and the normal use of a continuous paper separator between adjacent wraps.

There has thus been a need for a storage reel of the type adapted for winding bandoliered leaded components thereon, wherein the reel core is constructed in a manner that would prevent any bending of the leads of a predetermined number of components at the start of the first wrap, when the effective diameter of the core is smallest, and the tape carrier-induced bending forces exerted on the component leads is greatest, and which core would also substantially reduce the maximum possible bending of the leads of a similar, but progressively increasing, number of components at the start of the second and subsequent wraps.

SUMMARY OF THE INVENTION

In accordance with the principles involved in several preferred storage reel embodiments, particularly adapted for winding tubular leaded components in bandolier fashion on the core thereof, the latter is formed with a uniquely configured peripheral relief. The relief is located along a central region of the core, and is preferably formed as a depression having either a concave base, or a ramp-like base, as viewed in the circumferential direction. With respect to winding bandoliered components of the capacitor type, each having a cylindrical body portion with opposite side axially disposed leads, the relief of concave configuration is dimensioned to accommodate the lower halves of the body portions of a predetermined number of the capacitors (e.g., five) at the beginning of the first wrap, as interconnected via a spaced pair of tape carriers.

Such a core relief is seen to advantageously eliminate any tape carrier-induced bending of the leads of those capacitors that are partially nested therewithin, with the bends in the leads of the remaining capacitors in the first wrap increasing in displacement, as normally experienced, to only ½ the diameter of the body portion of a capacitor. At the start of the second wrap, the core relief has the significant effect of reducing the maximum possible lead bend displacement of those second wrap capacitors that overlie the relief from 1½ times the diameter of a capacitor body portion, as normally experienced, to less than the diameter thereof.

With respect to the remaining capacitors in the second wrap, and upon the start of the third and subsequent capacitor wraps, the much larger and progressively increasing effective core diameter results in the distributed radially directed inward forces imparted by the tape carriers against the leads of the then wound capacitors progressively decreasing. In addition the use of a paper separator, that preferably has a width that extends to or beyond the ends of the leads of the bandoliered capacitors, also contributes to restrict any subsequent bending of the leads to a tolerable displacement, normally considerably less than 1½ times the diameter of the cylindrical body portion of a capacitor.

When the relief is formed with a ramp-like base, it is dimensioned to fully accommodate the lower half body portion of only one of several capacitors out of a predetermined number thereof in the first wrap that are at least partially nested within the relief. The remaining capacitors of the predetermined number thereof are successively positioned along an outwardly extending arc which is defined by, and while supported on, the ramp-like base, until the latter merges into the normal peripheral surface of the core. With such a configured core relief, it is seen that the possible tape carrier-induced bending of the leads of the capacitors partially nested within the relief gradually increases from no possible bending to a maximum bend displacement equal to only ½ the diameter of the body portion of a capacitor. The latter lead bend displacement would occur with the first capacitor that is supported directly on the peripheral surface of the core following the predetermined number thereof.

In accordance with another of the embodiments of the invention, the core relief could also simply take the form of a blanked-out opening, such as of rectangular configuration, if desired.

With respect to all of the above-described core relief embodiments, it is seen that they advantageously allow bandoliered components with even fragile axially disposed leads to be wound upon the core without experiencing any deleterious permanent bending of the leads. This assumes, of course, that the initial core diameter and tension on the tape carriers are properly chosen for any given winding (or unwinding) operation. Viewed another way, the core relief allows the reel core diameter to be smaller than would otherwise be possible without the core relief. As such, the number of bandoliered component wraps may be maximized for a storage reel having a core and flanges of given sized diameters.

DETAILED DESCRIPTION OF THE INVENTION

It should be appreciated that while the invention is described in detail herein primarily in regard to the winding (or unwinding) of a bandoliered array of capacitors having cylindrical body portions and axially disposed leads, the illustrative storage reels, incorporating a core with a uniquely formed peripheral relief, for preventing deleterious tape carrier-induced lead bending, are equally applicable for use in temporarily storing bandoliered leaded components of various other types, and/or having body portions of various other cross-sections, with similar beneficial results.

Figure 1:
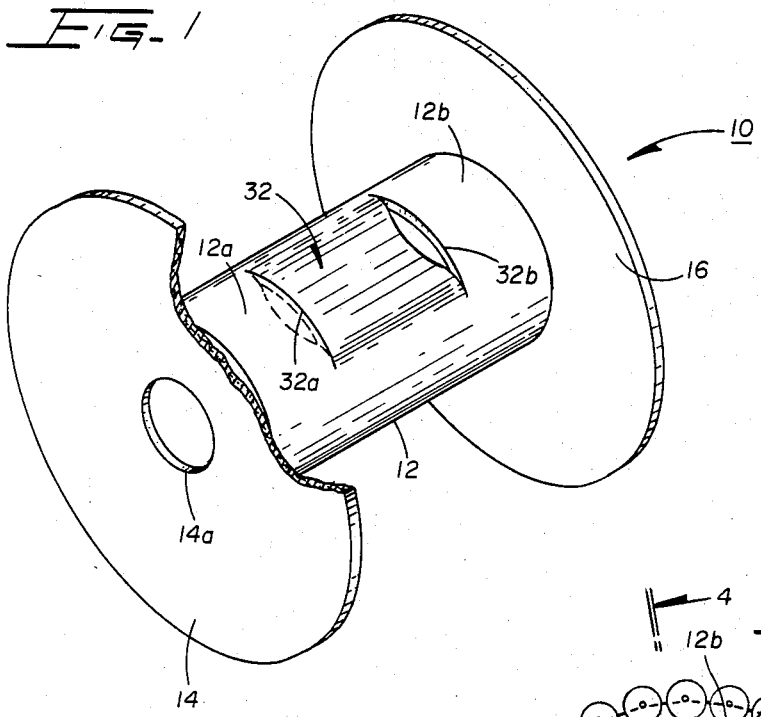
FIG. 1 is a perspective view of one preferred illustrative embodiment of a storage reel incorporating a core formed with a specially configured peripheral concave relief, the latter being adapted to minimize the possibility of any detrimental permanent bends being formed in the axially disposed leads of a bandoliered array of tubular components while being wound about the core, in accordance with the principles of the present invention.
Figure 2:
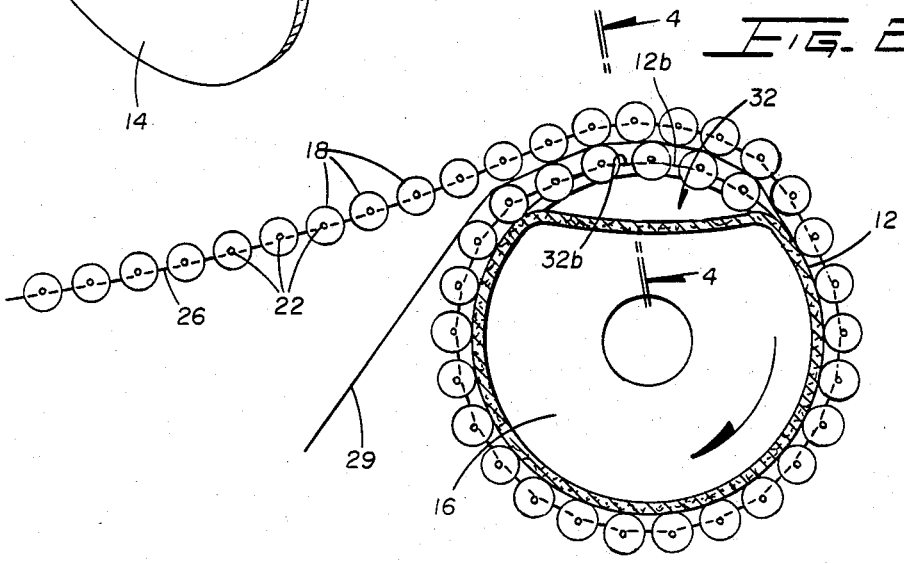
FIG. 2 is an end view, partially in section, of the storage reel core of FIG. 1 and, in particular, illustrates the manner in which the core relief formed therein functions to eliminate any tape carrier-induced bending of those bandoliered components in the first wrap that are partially nested therewithin, and to substantially minimize the possible bending of the leads of those components in the second wrap that overlie the relief, in accordance with the present invention.

With particular reference now to FIGS. 1 and 2, there is illustrated one preferred embodiment of a storage reel 10 comprised of a cylindrical core 12 having flanges 14 and 16 each fixedly secured to a different opposite end of the core. Each of the flanges, as illustrated, has a bore such as 14*a* adapted to receive and be rotatably driven by either a stub shaft, or a keyed elongated shaft that extends axially through the core and flanges (neither shown), in a well-known manner.

The storage reel 10, as will be more fully appreciated hereinbelow, is particularly adapted for winding (and unwinding) a bandoliered array of components, such as tubular capacitors 18, typically having relatively fragile opposite end, axially disposed wire-like leads 21, 22. The leads on each side of an array of capacitors, as bandoliered, are uniformly spaced by being secured to, and sandwiched between, a different pair of overlying-/underlying adhesive backed tapes which together form one of two laterally spaced tape carriers 26 or 27 (best seen in FIG. 5). A paper separator 29 is also normally interposed between adjacent wraps of the capacitors as wound in bandolier fashion on the core. Such a separator facilitates the attainment of uniform spacing between the capacitors in each wrap, prevents entanglement of the capacitors between wraps and, at least after the first several wraps, affords a limited, but significant, degree of support for the capacitor leads, as will be discussed in greater detail hereinbelow.

Figure 4:
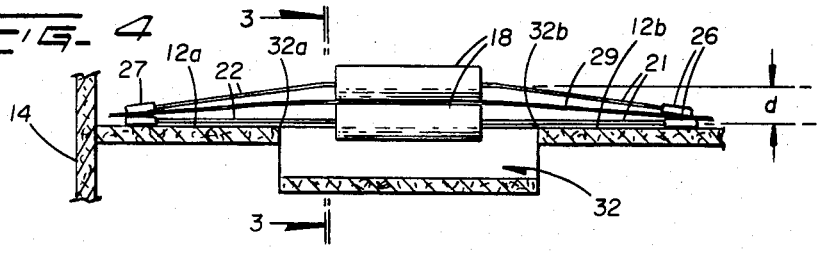
FIG. 4 is a fragmentary front elevational view, partially in section, taken along the line 4—4 of FIG. 2, illustrating in greater detail the core relief functions described above in connection with the description of FIG. 2.

In accordance with the principles of the present invention, a uniquely configured relief 32, preferably having a base of concave configuration, is formed in the periphery of the core 12. The relief is centrally located so as to define two border regions 12*a* and *b* on the periphery of the core, each one being interposed between a different circumferentially disposed edge 32*a* or *b* of the relief 32, and the inner surface of the respectively adjacent flange 14 or 16 (best seen in FIG. 4).

The core relief 32, when properly dimensioned, is adapted to advantageously eliminate any possible bending of the leads 21, 22 of a predetermined number of bandoliered capacitors 18 at the start of the first wrap thereof about the core 12, and to substantially reduce the maximum possible bending of the leads of those capacitors which overlie the relief at the start of the second wrap.

It is at such points during a winding (or unwinding) operation that the tape carrier-induced bending forces exerted on the capacitor leads can be most detrimental, i.e., form permanent bends in the leads. This follows from the fact that the lead bending force in question is directly related not only to the effective core diameter, but to the speed of advancement of the tape carriers. As a result, it is readily appreciated that the tape carrier-induced lead bending force is at a maximum at the start of the first wrap.

Figure 5:
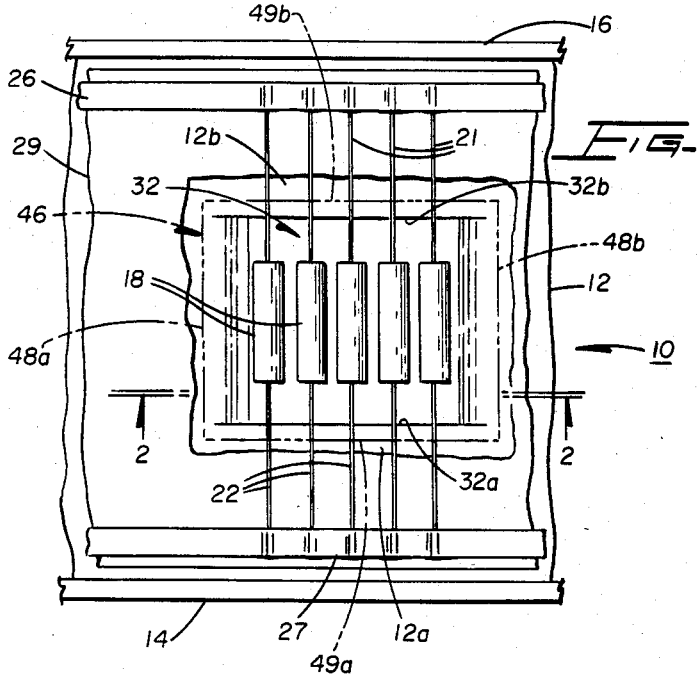
FIG. 5 is a fragmentary plane view illustrating in greater detail the relative positions of the leaded capacitors, laterally spaced tape carriers and paper separator relative to, and as being wound in bandolier fashion on, the core of the supply reel embodied in FIG. 1.

With respect to the start of the second wrap, and with reference at this point to a conventional core, the normally experienced abrupt increase in the maximum possible lead bend displacement from $\frac{1}{2}$ to $1\frac{1}{2}$ times the diameter of the body portion of a capacitor, while the effective core diameter is still relatively small, has also resulted in deleterious permanent bends being formed in some of the first few capacitors in the second wrap. Thereafter, the combination of the progressively increasing effective core diameter, and the use of the paper separator 29, substantially eliminates the possibility of any further tape carrier-induced permanent bending of the capacitor leads. This is particularly the case when the paper separator 29 is dimensioned to extend to or beyond the ends of the capacitor leads, as depicted in FIG. 5, and when such a separator is formed of a material exhibiting even only a small amount of stiffness.

Considering the unique function of the core relief 32 now in greater detail, reference is first made to FIG. 2. As therein illustrated, it is seen that the lower halves of the body portions of the first five capacitors 18 at the start of the first wrap, by way of example only, are all nested within the relief 32. As such, the axially disposed leads 21, 22 of such partially nested capacitors rest directly and/or via the tape carriers 26, 27, on the respective border regions 12*a*, 12*b* of the core. Starting with the sixth capacitor in the first wrap, the maximum possible displacement of the leads of that capacitor, as well as of all of the other capacitors in the first wrap, is limited to only $\frac{1}{2}$ the diameter of the body portion of a given capacitor, as normally experienced, less the thickness of the underside tape of the associated tape carrier 26 or 27.

Figure 3:
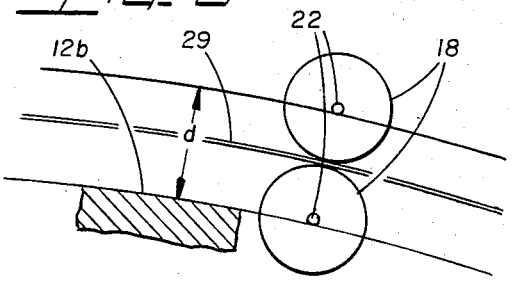
FIG. 3 is an enlarged, fragmentary end view, partially in section, taken along the line 3—3 of FIG. 4, of two radially aligned ones of the first and second wrap components that overlie the core relief depicted in FIG. 2, and further shows in greater detail the two associated tape carriers and the paper separator interposed between the components.

More importantly, however, at the start of the second bandoliered capacitor wrap, the core relief 32 has the effect of reducing the maximum possible lead bend displacement of the first six capacitors in that wrap, that overlie the relief, to the diameter of the body portion of a given capacitor, less the then accumulative build-up of the associated tape carrier 26 or 27, and the thickness of one layer of the paper separator 29. This maximum lead bend displacement is identified by the letter "d" in FIGS. 3 and 4. The reason for six rather than five capacitors overlying the core relief in the second wrap is because of the larger effective diameter of the latter. The maximum possible displacement of the leads of the remaining capacitors in the second wrap is equal to $1\frac{1}{2}$ times the diameter of the body portion of a given capacitor, less the then accumulative build-up of the associated tape carrier, and the thickness of one layer of the paper separator 29.

During the last mentioned portion of the second wrap, however, and upon the start of the third and subsequent bandoliered capacitor wraps, as previously noted, the then considerably larger and progressively increasing effective core diameter, and the paper separator 29 between adjacent wraps, both normally contribute to prevent any further possible tape carrier-induced detrimental bending of the capacitor leads during a given winding (or unwinding) operation. In this regard, it is reiterated that the diameter of each capacitor body portion, and the length, gauge and material out of which the leads are fabricated, will all have a direct bearing on the maximum tape carrier-induced lead bending force that may be tolerated at any point in time without effecting permanent tape carrier-induced bends in the leads. Concomitantly, and as also previously noted, the chosen diameter of the reel core, and the speed of winding, have a direct bearing on the magnitude of the bending force exerted on the leads by the tape carriers at any point in time during a winding (or unwinding) operation and, thus, are parameters that must also be properly chosen for any given application.

Figure 6:
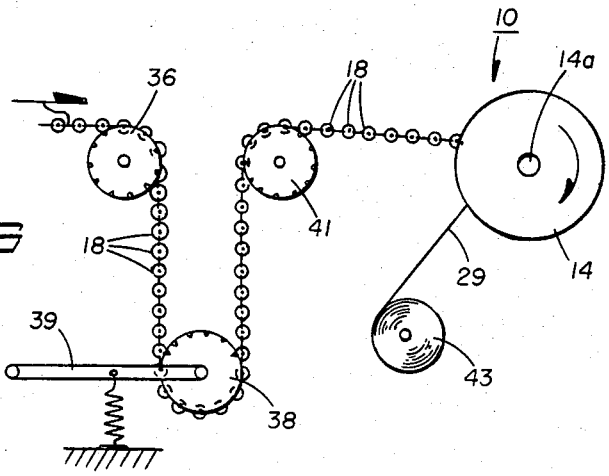
FIG. 6 is a schematic view of a preferred winding system, including a tensioning mechanism to control and minimize the tension exerted on the tape carriers of a bandoliered array of tubular components while being wound upon the core of a storage reel of the type embodied in FIG. 1.

Inasmuch as the tension on the advancing tape carriers directly determines the magnitude of bending force exerted by the latter on the leads of the capacitors, it is normally very desirable to continuously control the amount of such tension. To that end, there is illustrated in FIG. 6 a tape carrier tensioning mechanism which comprises a first fixed position idler roller 36, a second idler roller 38, rotatably secured to one end of a spring-biased dancer arm 39, and a second fixed position idler roller 41. Such a mechanism reduces the tension on the tape carriers by one half from that developed with only one fixed idler roller, while winding a bandoliered array of capacitors (or any other type of leaded components) on the core 12 of the illustrative storage reel 10 embodied herein.

In such a winding operation, the paper separator 29 is generally advanced from a supply reel 43 onto the core simultaneously with, and on the underside of, each successive wrap of bandoliered capacitors, excluding the first wrap. Both the leading end of the tape carriers and the leading end of the paper separator are normally manually secured to the core, such as with adhesive-backed tape, depicted only generally in FIG. 2, prior to the start of the first wrap of bandoliered capacitors about the core.

For the one particular winding application described herein, wherein the core relief 32 was of concave configuration, it was formed with a width of approximately 1.75", a length of $1\frac{7}{8}$" and a maximum depth of $\frac{5}{8}$". As thus dimensioned, the core relief allowed the partial nesting therewithin of the first five capacitors 18 of the first wrap, wherein the capacitors had a nominal cylindrical body diameter of 0.250", a length of 1.031", with axial leads of 22 gauge copper-clad steel, each measuring approximately 1.25" in length, and with the capacitors being interconnected in bandolier fashion with center-to-center spacings (or a pitch) of 0.374". With the storage reel having a chosen nominal core diameter of 3.0", and driven at a tension-controlled speed of 8.1 rpm, no detrimental tape carrier-induced bending of the capacitor leads were found to occur during the winding operation.

It is understood, of course, as previously noted, that the optimum number of bandoliered, tubular leaded components that should be partially nested within a given relief 32 for a particular winding (or unwinding) operation will vary somewhat, depending on both the physical parameters of the component, the core diameter of the reel, and the chosen speed for winding (or unwinding) such components.

The lateral width of the relief 32 may vary appreciably, and may be chosen to accommodate a number of different codes of components, as long as the peripheral core border regions 12*a* and *b* (see FIGS. 1 and 4) have sufficient width on opposite sides of the relief so as to provide adequate support for the leads of the tape carrier-advanced components. As for the depth of the relief 32, the only requirement in that regard is that it be sufficient to accommodate whatever outer profile the lower halves of the body portions of the chosen number of capacitors (or other leaded components), may have.

Figure 7:
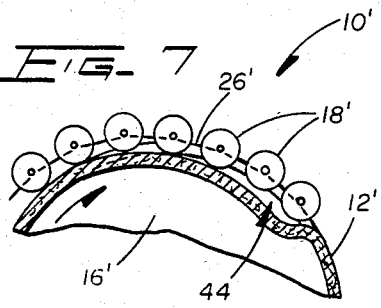
FIG. 7 is an enlarged, fragmentary end view, partially in section, of a second preferred embodiment of the storage reel core and, in particular, illustrates a core relief formed with a depressed ramp-like base portion.

FIG. 7 illustrates a second preferred embodiment of the invention wherein a storage reel 10' incorporates a core 12' formed with a modified core relief 44 having a ramp-like base 44*a*. The latter is dimensioned at its forward end, as defined herein relative to the direction of intended reel rotation during a winding operation, to fully accommodate the lower half body portion of only one, or several capacitors 18' (two being illustrated) out of a larger predetermined number thereof (e.g., five) at the forward end of the first wrap.

With respect to the remaining three capacitors out of the total predetermined number equal to five in the illustrative example, they are seen to be successively positioned along an upwardly and outwardly extending arc defined by, and while supported on, the ramp-like base 44*a* of the core relief. Thereafter, the ramp-like lase gradually and smoothly merges into the normal peripheral surface of the core. The core relief base 44*a* is thus seen to have a maximum depth at the above-defined forward end of the relief, and a minimum depth, which finally smoothly merges into the normal peripheral surface of the core 12', at the opposite rearward end of the relief.

The primary function of the ramp-like relief 44 is to allow the tape carriers to progressively increase the lead bend displacement of successive capacitors partially nested within the relief from zero to a displacement chosen to be slightly less than ½ the diameter of the body portion of a capacitor, which is the maximum possible displacement for any capacitor in the first wrap. In the illustrative example, a small amount of tape carrier-induced lead bend displacement is seen to start with the third capacitor from the leading end of the first wrap, and gradually increases until the maximum possible displacement is reached, which starts with the sixth capacitor supported directly on the peripheral surface of the core. In this connection, it is appreciated, of course, that the ramp-like base of the core relief 44 may have any desired contour, and be dimensioned to partially receive any desired number of capacitors (or other leaded components), as required for a particular winding operation.

In all other respects, the storage reel 10', shown only in fragmentary form, is essentially identical to the reel 10 of FIG. 1. As such, the other structural features of the reel 10' that respectively correspond with those of the reel 10 of FIG. 1 are identified by like, but primed reference numerals.

In accordance with a third embodiment of the invention, shown only in FIG. 5, the core relief may simply take the form of a suitably dimensioned blanked-out opening of parallelogrammatic configuration, identified only generally by the reference numeral 46. The outline of such an alternative core relief is shown only in phantom in FIG. 5 by the dash-dot-dot lines 48*a, b* and 49*a, b*. The size of the relief 46 is shown as being larger in cross-section than the concave relief 32, shown in detail, only for the purpose of illustrative clarity. The blanked-out core relief 46 may prove particularly beneficial, for example, when the reel core is to be fabricated out of a material that cannot be molded or die cast, and is relatively rigid and non-ductile.

With respect to the fabrication of any of the storage reels embodied herein, they are preferably formed out of non-conductive material, such as cardboard, wood, or plastic material, when employed to temporarily store bandoliered electrical components. However, the reel may also be fabricated out of a suitable metal, such as initially in sheet stock form.

When at least the core of the reel, for example, is of cardboard, as in the illustrative embodiments, the concave relief 32 in the storage reel 10, for example, may be readily constructed by initially forming two circumferentially disposed and laterally spaced slits (defining the previously identified edges 32*a* and *b*) in the core and, thereafter, employing a suitable die-forming member (not shown) with the proper width and radius to form the desired depression in the periphery of the core. With properly constructed tooling, the slitting and concave-forming operations may be readily accomplished simultaneously in either a manual or automated manner. Should the reel core be molded out of a suitable plastic material, the relief 32 could then be readily formed with any one of a number of equally effective configurations during the molding operation. The core relief 44 with a ramp-like base, may be readily formed in similar ways.

While several preferred storage reel embodiments have been disclosed herein, for one particular use in winding, temporarily storing and thereafter unwinding an array of tubular leaded components interconnected in a bandoliered manner, it is obvious that various modifications may be made to the present illustrative claimed embodiments of the invention, and that a number of alternative related embodiments could be devised by one skilled in the art without departing from the spirit and scope of the invention.

What is claimed is:

1. A bandoliered package of cylindrical electrical components, each of the components having a pair of oppositely extending axial leads, which comprises:

a cylindrical core having a peripheral relief of a depth greater than one-half the diameter of the cylindrical electrical component and a width greater than the length of electrical component, said relief having peripheral length exceeding the length of a predetermined number of the electrical components spaced apart by predetermined uniform distances;

said core having unrelieved sections adjacent said relief of lengths exceeding the length of the leads projecting from the electrical components;

a pair of adhesive coated strip means adhered to the axially extending leads of the components to provide a bandolier of electrical components which are spaced apart by said predetermined uniform distances, said bandolier convoluted about said core with a leading inner convoluted section consisting of said predetermined number of said bandolier electrical components received in said relief; and said bandoliered leads projecting from the components within said relief to rest on and be supported against bending by said unrelieved sections of said core.

2. The bandoliered package as recited in claim 1 wherein said core further includes a spaced pair of flanges respectively secured to opposite ends of said core.

3. The bandoliered package as recited in claim 1 further includes means positioned between successive wraps of said bandolier convoluted about said core for reducing lead displacement.

4. A bandoliered package of cylindrical electrical components, each of the components having a pair of oppositely extending axial leads, which comprises:

a cylindrical core having a pair of flanges secured to opposite ends thereof and a peripheral relief formed therein, said relief having a depth greater than one-half the diameter of the cylindrical electrical component, a width greater than the length of the electrical component and a peripheral length exceeding the length of a predetermined number of the electrical components spaced apart by predetermined uniform distances;

said core having unrelieved sections adjacent said relief to lengths exceeding the lengths of the leads projecting from the electrical components;

a pair of adhesive coated strip means adhered to the axially extending leads of the components to provide a bandolier of electrical components which are spaced apart by said predetermined uniform distances, said bandolier convoluted about said core with a leading inner convoluted section consisting of said predetermined number of said bandoliered electrical components received in said relief;

said bandoliered leads projecting from the components within said relief to rest on and be supported against bending by said unrelieved sections of said core; and means positioned between successive wraps of said bandolier convoluted about said core for reducing lead displacement.

* * * * *